United States Patent [19]

Alger et al.

[11] 4,068,495

[45] Jan. 17, 1978

[54] CLOSED LOOP SPRAY COOLING APPARATUS

[75] Inventors: Donald L. Alger; William B. Schwab, both of Cleveland; Edward R. Furman, North Olmsted, all of Ohio

[73] Assignee: The United States of America as represented by the United States National Aeronautics and Space Administration, Washington, D.C.

[21] Appl. No.: 672,220

[22] Filed: Mar. 31, 1976

[51] Int. Cl.[2] ..... F25D 17/02

[52] U.S. Cl. ..... 62/376; 62/514 R; 313/22

[58] Field of Search ..... 313/11, 13, 22, 30, 313/34, 35, 39; 62/64, 74, 373, 374, 375, 376, 514 R

[56] References Cited

U.S. PATENT DOCUMENTS

| | | | |
|---|---|---|---|
| 2,286,225 | 6/1942 | Noyes | 62/64 |
| 2,924,635 | 2/1960 | Narbut | 62/514 R |
| 3,258,602 | 6/1966 | Promish | 62/514 R |
| 3,525,228 | 8/1970 | Anderson | 62/514 R |

*Primary Examiner*—Ronald C. Capossela

*Attorney, Agent, or Firm*—N. T. Musial; J. A. Mackin; J. R. Manning

[57] ABSTRACT

A closed loop apparatus for spraying coolant against the back of a radiation target. The coolant is circulated through a closed loop with a bubble of inert gas being maintained around the spray. Mesh material is disposed between the bubble and the surface of the liquid coolant which is below the bubble at a predetermined level. In a second embodiment no inert gas is used, the bubble consisting of vapor produced when the coolant is sprayed against the target.

10 Claims, 2 Drawing Figures

CLOSED LOOP SPRAY COOLING APPARATUS

ORIGIN OF THE INVENTION

The invention described herein was made by employees of the U.S. Government and may be manufactured and used by or for the Government for governmental purposes without the payment of any royalties thereon or therefor.

BACKGROUND OF THE INVENTION

1. Field of the Invention

The present invention relates generally to cooling apparatus, and more particularly to apparatus for cooling radiation targets.

2. Description of the Prior Art

In the past it has been customary to cool the targets of positive ion accelerators, lasers, and the like, by means of a high velocity flow of coolant, usually water, over the heated target. It is known that improved heat transfer from target to coolant at the same flow rate can be obtained if one, instead, sprays a high velocity jet of the coolant onto the rear of the target. Jet spray cooling is more efficient because the fluid boundary layer at the heat transfer surface is minimized. However, the jet spray cooling technique suffers from the disadvantage that ambient air or gas can become trapped as bubbles in the coolant spray. It appears that this problem, until now, has precluded use of a jet spray with a system for recirculating the unvaporized liquid coolant, as no such apparatus is known to date.

BRIEF SUMMARY OF THE INVENTION

It is therefore one object of the present invention to provide an improved closed loop cooling apparatus.

It is another object of the present invention to provide such an apparatus incorporating jet spray cooling.

It is yet another object of the present invention to provide such an apparatus incorporating jet spray cooling in which the problem of trapped gas is minimized or avoided completely.

The objects of the present invention are achieved in one embodiment by a closed loop apparatus for spray cooling a radiation target. The cooling apparatus comprises a loop for circulating liquid coolant including a coolant reservoir, a chamber containing gas and communicating with the target, and first and second tubular connections between the reservoir and the chamber for circulating the liquid coolant therethrough. The cooling apparatus further includes means disposed within the chamber and connected to one of the tubular connections for spraying the liquid coolant against the back of the target, and means for separating trapped gas from the liquid coolant flowing off the target.

In a second embodiment of the invention, the cooling apparatus comprises a loop for circulating liquid coolant including a coolant reservoir, a gastight chamber containing vaporized coolant and communicating with the target, and first and second tubular connections between the reservoir and the chamber for circulating the coolant liquid therethrough. The cooling apparatus further includes means disposed within the chamber and connected to one of the tubular connections for spraying liquid coolant against the back of the target.

The foregoing, as well as other objects, features and advantages of the present invention will become more apparent from the following detailed description taken in conjunction with the appended drawings.

DESCRIPTION OF THE PREFERRED EMBODIMENTS

Figure 1:
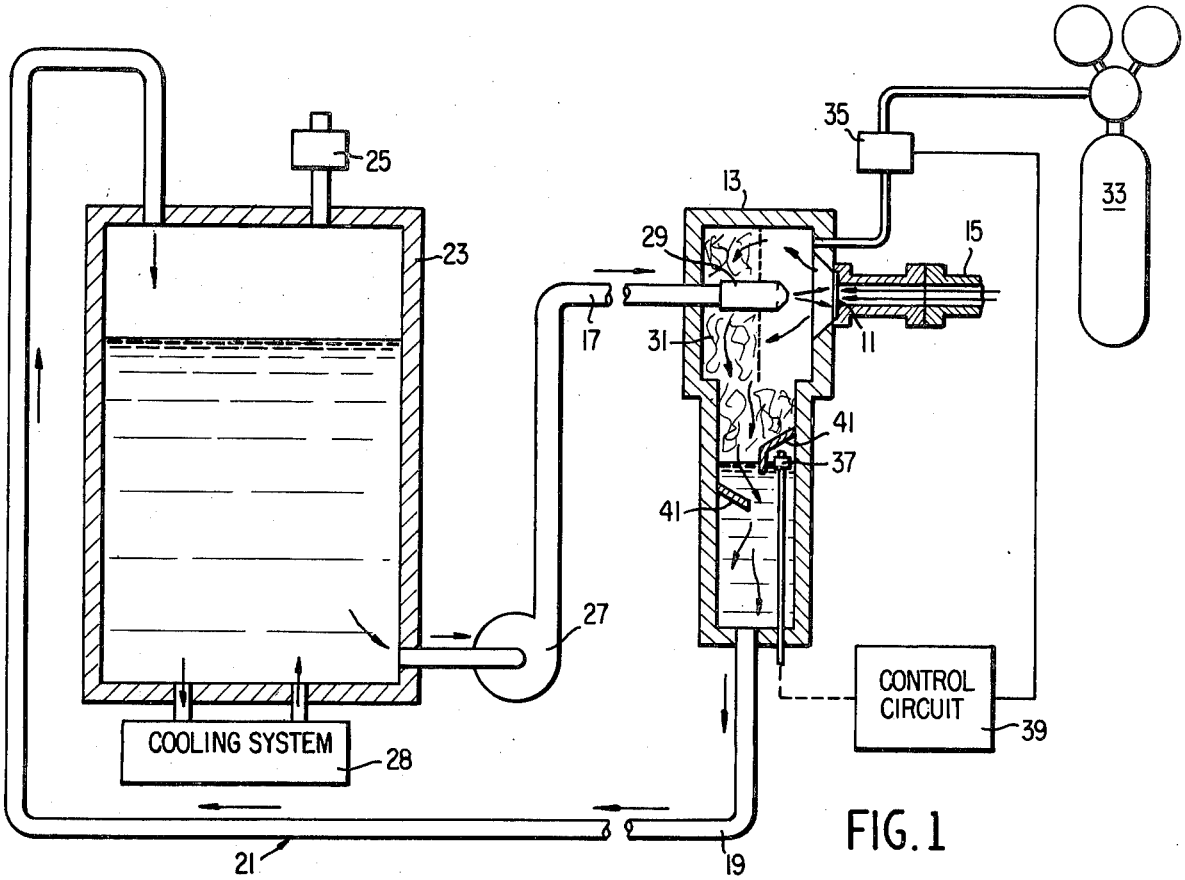
FIG. 1 is a diagram of a first embodiment of the closed loop spray cooling apparatus.

Referring now to the drawings, wherein like reference numerals designate identical or corresponding parts, there is shown in FIG. 1 a diagram of a first embodiment of the closed loop spray cooling apparatus.

An accelerator target 11 to be cooled is clamped by means of a flange against an opening in one end of a T shaped gastight chamber 13. A beam of electrons or ions striking the target originates in a linear accelerator 15, only the outer end of which is shown. Tubular connections 17 and 19 of the coolant loop 21 communicate with the other ends of the chamber. Circulation of the liquid coolant from an isothermal reservoir 23 having a relief vent valve 25 is maintained by a pump 27. The temperature of the liquid coolant in the reservoir 23 is held nearly constant by a conventional cooling system 28. One of the tubular connections 17 enters an inlet at one end of the chamber 13. A nozzle 29 attached to the tubular connection 17 is fixed opposite the rear of the target 11. The other tubular connection 19 communicates with an outlet at the lower end of the chamber 13 to draw off the exhausted liquid coolant. A high surface area mesh 31 of stainless steel wool, shredded plastic or the like, is stuffed inside the chamber 13 and confined at the rear of, and to a predetermined depth below, the nozzle 29. A source of high pressure inert gas 33 communicates with the target end of the chamber 13 and a solenoid valve 35 interposed between the source of gas and the chamber regulates the supply of gas to the chamber. A float switch 37 disposed in the liquid coolant within the chamber is connected to a conventional control circuit 39 for opening and closing the solenoid valve 35 in response to rise and fall of the float switch with coolant level. A pair of baffles 41 mounted to the walls of the chamber 13 shield the float switch from the flow of coolant.

In operation, the liquid coolant is circulated around the coolant loop 21 by the pump 27 and fills the chamber 13. The float switch 37 is raised by the coolant to its up position completing the control circuit 39. Completion of the control circuit causes the solenoid valve 35 to open, letting gas from the source 33 flow into the chamber 13. The liquid coolant is displaced by the gas and its level is lowered by the gas flow until the float switch drops into its down position. This action opens the control circuit and closes the solenoid valve, stopping flow of gas to the chamber. The liquid coolant issues as a jet from the nozzle 29 and is sprayed against the back of the target 11 with a "bubble" of inert gas being maintained around the spray. The mesh material 31 disposed between the bubble and the coolant surface below the bubble at a predetermined level separates the trapped gas from the exhausted liquid coolant as it flows off the target. If the chamber is gastight, the flow rate is kept constant, and the gas-liquid separation by the mesh material is complete, no further inert gas flow is required to maintain the bubble. However, should a small fraction of the gas be trapped in the liquid coolant and pass from the chamber to the reservoir 23, the float switch will rise to its up position and inert gas will again be supplied from the source to the chamber to maintain the coolant level constant.

The pressure of the inert gas in the chamber is just equal to the incremental pressure resistance due to pipe frictional losses between the chamber outlet and the reservoir inlet. This incremental pressure is a function of the gas flow rate. The size of the chamber and the amount of high surface area material required are also functions of the gas flow rate. The mesh can be placed anywhere in the chamber so long as sufficient material is present to cause separation of trapped gas from a liquid coolant. It may be advantageous to have no mesh in the chamber, but to have a series of large diameter chambers containing the material in the loop following the chamber. The relief vent valve attached to the reservoir is normally set at a pressure slightly above atmospheric pressure. The gas used in the chamber need not be inert gas. Inert gas is preferred when demineralized water is the coolant in order to provide a very high resistivity water. But air may be used, and the reservoir relief valve is then vented directly to the atmosphere.

Figure 2:
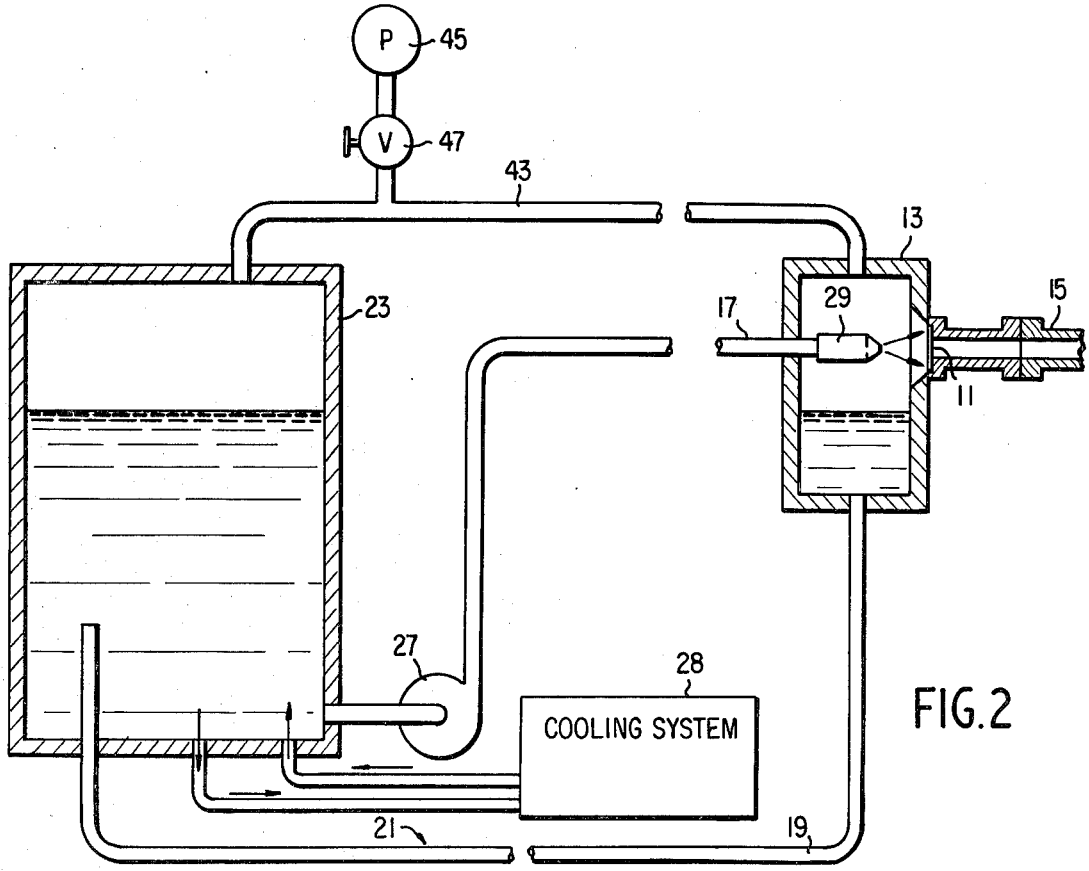
FIG. 2 is a diagram of a second embodiment of the closed loop spray cooling apparatus.

FIG. 2 illustrates a second embodiment of the closed loop spray cooling apparatus. An accelerator target 11 to be cooled is clamped by means of a flange against an opening in one end of a T shaped gastight chamber 13. Tubular connections of a coolant loop 21 communicate with the other ends of the chamber. Circulation of the liquid coolant from an isothermal reservoir 23 is maintained by a pump 27. The temperature of the liquid coolant in the reservoir 23 is held nearly constant by a conventional cooling system 28. One of the tubular connections 17 enters an inlet at one end of the chamber 13. A nozzle 29 attached to the tubular connection 17 is fixed opposite the rear of the target 11. The other tubular connection 19 communicates with an outlet at the lower end of the chamber 13 to draw off the exhausted liquid coolant. A gas equalizer vacuum line 43 interconnects the reservoir 23 with the chamber 13. A pump 45 communicates with the equalizer vacuum line through an isolation valve 47.

In operation, the liquid coolant is circulated around the coolant loop 21 by the pump 27 until the level in the reservoir 23 and in the chamber 13 are the same. The isolation valve 47 is opened and the pump 45 is permitted to evacuate the closed system, after which the isolation valve is again closed. Circulation of the liquid coolant is resumed, relying on gravity for return of the liquid coolant from the chamber to the reservoir. The liquid coolant issues as a jet from the nozzle 29 and is sprayed against the back of the target 11 with a "bubble" of vaporized coolant now maintained around the spray. Since no gas is present in the system, separation of trapped gas from the exhausted coolant liquid as it flows off the target is not required.

Obviously numerous additional modifications and variations of the present invention are possible in light of the above teachings. For example, in the first embodiment, a gas equalizer line can be included between the chamber and the reservoir to eliminate the gas pressure-head and establish a gravity induced liquid-gas interface in the chamber and reservoir. Alternatively, in the first embodiment, the lower portion of the chamber can be expanded to provide an enlarged liquid-gas surface area designed to permit sufficient residence time for the liquid-gas mixture to separate. It is therefore to be understood that within the scope of the appended Claims, the invention may be practiced otherwise than is specifically described herein.

What is claimed as new and desired to be secured by Letters Patent of the United States is:

1. A closed loop apparatus for spraying a radiation target with liquid coolant comprising:

a loop for circulating the liquid coolant including a coolant reservoir, a chamber communicating with the target, and first and second tubular connections between the reservoir and the chamber for circulating the liquid coolant therethrough;

means disposed within the chamber and connected to one of the tubular connections for spraying the liquid coolant against the back of the target;

a source of high pressure gas communicating with the chamber; and means for regulating the supply of gas to the chamber.

2. The closed loop apparatus recited in claim 1 wherein the chamber contains gas, and including means for separating trapped gas from the liquid coolant flowing off the target.

3. The closed loop apparatus recited in claim 2 wherein:

the gas separating means is a high surface area mesh spaced within the chamber about the spraying means.

4. The closed loop apparatus recited in claim 3 wherein:

the mesh is composed of stainless steel wool.

5. The closed loop apparatus recited in claim 3 wherein:

the mesh is composed of shredded plastic.

6. The closed loop apparatus recited in claim 1 wherein: the gas supply regulating means includes:

a valve interposed between the source of high pressure gas and the chamber and through which the source of high pressure gas communicates with the chamber; and control means responsive to changes in the liquid coolant level within the chamber for opening and closing the valve to maintain the liquid coolant level constant.

7. The closed loop apparatus recited in claim 6 wherein:

the control means includes a float switch disposed in the liquid coolant within the chamber.

8. The closed loop apparatus recited in claim 7 including:

at least one baffle mounted to a wall of the chamber for shielding the float switch from the flow of liquid coolant.

9. The closed loop apparatus recited in claim 8 including:

means for holding the temperature of the liquid coolant in the coolant reservoir constant.

10. The closed loop apparatus recited in claim 1 wherein the chamber is gastight and contains vaporized coolant.

* * * * *